US006000584A

United States Patent [19]

Kopp

[11] Patent Number: 6,000,584

[45] Date of Patent: Dec. 14, 1999

[54] GUN FOR THE PRODUCTION OF ADHESIVE FOAM

[76] Inventor: Volker Kopp, Santisstrasse 29, CH-8133 Esslingen, Switzerland

[21] Appl. No.: 09/003,453

[22] Filed: Jan. 6, 1998

[30] Foreign Application Priority Data

Jan. 7, 1997 [DE] Germany ..... 19700259

[51] Int. Cl.[6] ..... B22D 37/00

[52] U.S. Cl. ..... 222/509; 222/518

[58] Field of Search ..... 222/509, 518, 222/542

[56] References Cited

U.S. PATENT DOCUMENTS 5,097,993 3/1992 Davis ..... 222/518 X 5,271,537 12/1993 Johnson ..... 222/509

FOREIGN PATENT DOCUMENTS 44 12 282 A1 10/1995 Germany ..... B05B 7/04

*Primary Examiner*—Gregory L. Huson

[57] ABSTRACT

A gun for producing adhesive foam has a nozzle tube, a delivery lever, a nozzle needle coaxial in the nozzle tube, and pressed by a force storage member into its dosing position. A coupling device is positioned between the delivery lever and the nozzle needle, by which a given position of the delivery lever corresponds to a given position of the nozzle needle. A cavity borders on the nozzle tube. A wall section is arranged between the coupling device and the cavity and bounds the cavity. A guide and a seal are arranged in the wall section. The guide is integrated into the seal.

22 Claims, 3 Drawing Sheets

GUN FOR THE PRODUCTION OF ADHESIVE FOAM

BACKGROUND OF THE INVENTION

1. Field of the Invention

This invention relates to a gun for producing adhesive foam, and more particularly, to a gun with a nozzle tube, a delivery lever, and a nozzle needle arranged coaxially in the nozzle tube.

2. Discussion of Relevant Art

Such a device is known, for example, from German Patent DE 44 12 282.

When the adhesive foam can is screwed on, the fluid under pressure is present in a cavity and in the nozzle tube of the gun. Passing through the cavity and nozzle tube is a nozzle needle which in its closing position seals off the outlet opening of the nozzle tube. When the delivery lever is pulled, the nozzle needle is pulled out of its closing position, and the fluid under pressure can emerge from the outlet opening. The cavity is bounded by a wall section which has a bore in which is arranged the guide means for guiding the nozzle needle.

In the known guns, the guiding is effected by a bore in the wall section. So that the fluid under pressure does not get out into the housing space of the gun and in the course of time render inoperative the coupling device between the delivery lever and the nozzle needle, and also further elements located in the housing of the gun, two lip seals for sealing the needle are provided in the known guns on the side of the guide remote from the cavity.

In these known guns a sufficient sealing is indeed attained. However, the production and materials costs are disadvantageous here, as are the difficulties which arise when the seal becomes damaged.

SUMMARY OF THE INVENTION

The object of the present invention is to provide a gun of the kind mentioned above in which the desired sealing of the fluid-containing cavity from the interior of the gun housing is attained in a simple and inexpensive manner, and in addition the problem of damage to the seals is solved.

According to the invention, this object is attained by a gun for producing adhesive foam having a nozzle tube, a delivery lever, and a nozzle needle arranged coaxially in the nozzle tube. The adhesive foam gun also includes a force storing device for pushing the nozzle needle into a nozzle-closing position, a couple between the delivery lever and the nozzle needle by means of which a given position of the delivery lever corresponds to a given position of the nozzle needle, a surface forming a cavity adjacent to the nozzle tube, a wall section bounding the cavity between the couple and the cavity, and a seal with a guide integrated into the seal.

Good sealing, and good self-regenerating properties of the seal are attained when the diameter DB of the bore in the wall section in the region of the seal and that of the region of the nozzle needle which passes through the wall section are small in comparison to the diameter $D_T$ of the region of the nozzle needle that is located within the nozzle tube.

It is recommended that $D_B$ is smaller or equal to 0.5 times $D_T$. Preferably, $D_B$ is less than or equal to 0.3 times $D_T$, and a ratio of $D_B$: $D_T$=0.13±0.10 is particularly preferred.

The diameter of the nozzle needle in the region of the sealing means is preferably smaller than 6 mm, and particularly preferably, smaller than 2 mm.

If the diameter of the nozzle needle in the region of the seal is small in comparison with the diameter of the nozzle needle in the nozzle tube, materials can be used for sealing which are normally excluded as sealing material for polyurethane adhesive foam, for example, because they take up water.

Zytel™ can be used as the sealing material in the present invention. This is a polyamide of the Dupont Company, and is considerably cheaper than the Teflon (PTFE) used in the state of the art. Additionally, costs are reduced because the amount of seal material would be considerably reduced in comparison to the state of the art, due to the small diameter of the nozzle needle in the region of the seal.

Surprisingly, the reduction of the diameter of the nozzle needle in the region of the seal also effects an improvement in the self-regenerating properties of the seal due to the fluid present in the cavity of the gun. The regeneration of the seal particularly takes place when the seal is of Zytel™ and the gun is used for the production of polyurethane foam and glue.

Production costs are reduced by a special construction of the region of the nozzle needle located in the region of the seal. No special roundness or cylindrical shape accuracy of the wire are necessary. The wire can simply be cut from a reel of wire. To make sure the wire is as hard as required, spring steel is preferably used. It is also unnecessary for the wire to be surface treated.

The choice of the materials for the hollow body of the gun depend on the stress requirements to be placed on the gun. Suitable materials are, for example, aluminum or plastic.

It is furthermore possible to make the whole hollow body in one piece, which likewise reduces the production costs.

The housing of the gun is preferably in one piece and of plastic. However, other materials can also be used.

Furthermore, it is possible to connect the hollow body and the housing together. For attachment of the adhesive foam can, a thread is provided on the hollow body and/or on the housing for fastening an adapter onto which the adhesive foam can may be screwed.

So that the nozzle needle, when first introduced through the bore in the wall section and the seal does not of itself punch out a burr, it is advisable to provide at least one lead-in bevel laterally of the guide of the seal.

In another embodiment, the seal has no lead-in bevels. The nozzle needle is easily inserted because the wire is chamfered.

BRIEF DESCRIPTION OF THE DRAWINGS

The present invention will now be described, taken together with the drawings, in which.

DETAILED DESCRIPTION OF A PREFERRED EMBODIMENT

Figure 1:
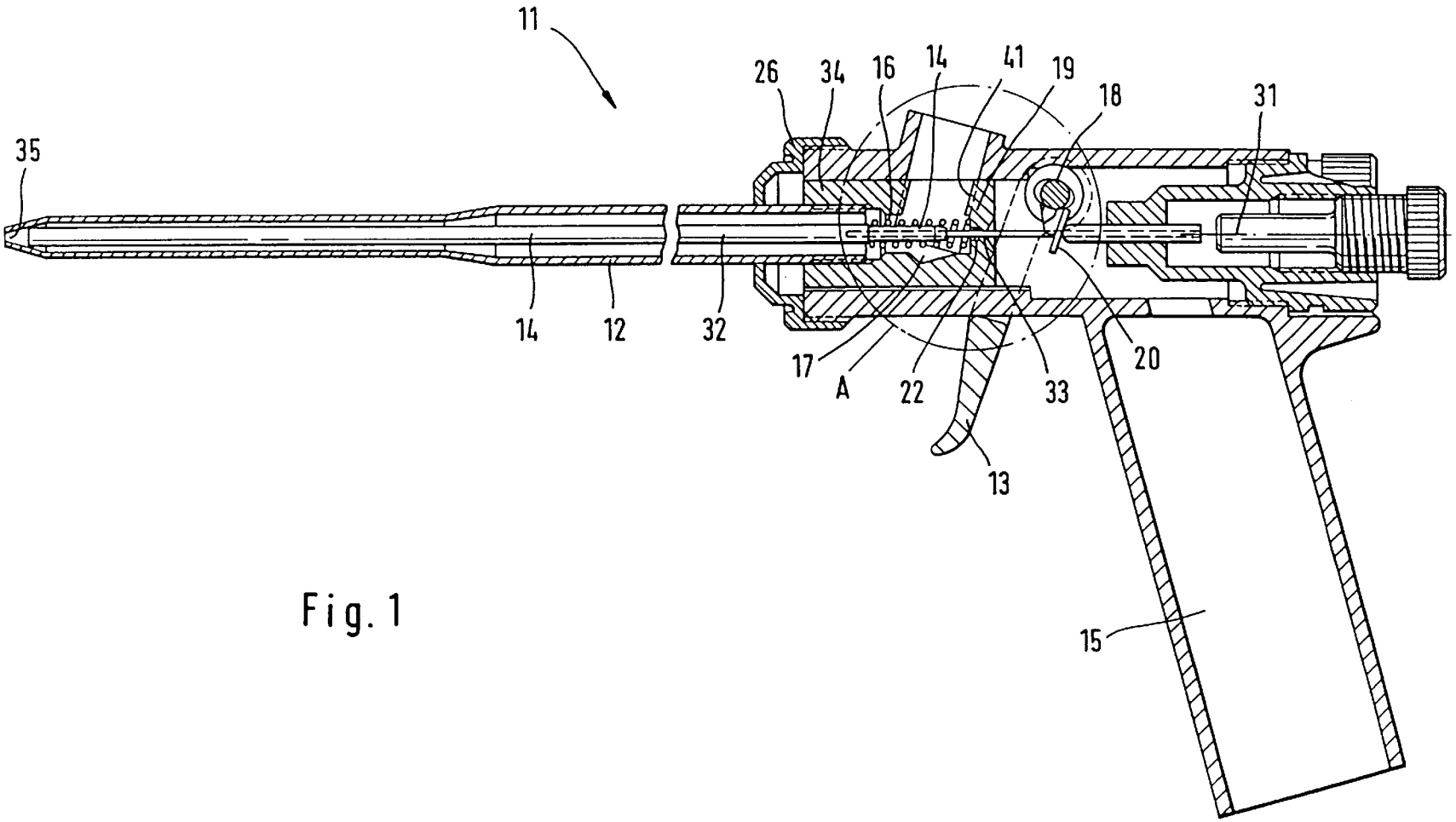
FIG. 1 shows a schematic partial longitudinal section of the gun.
Figure 2:
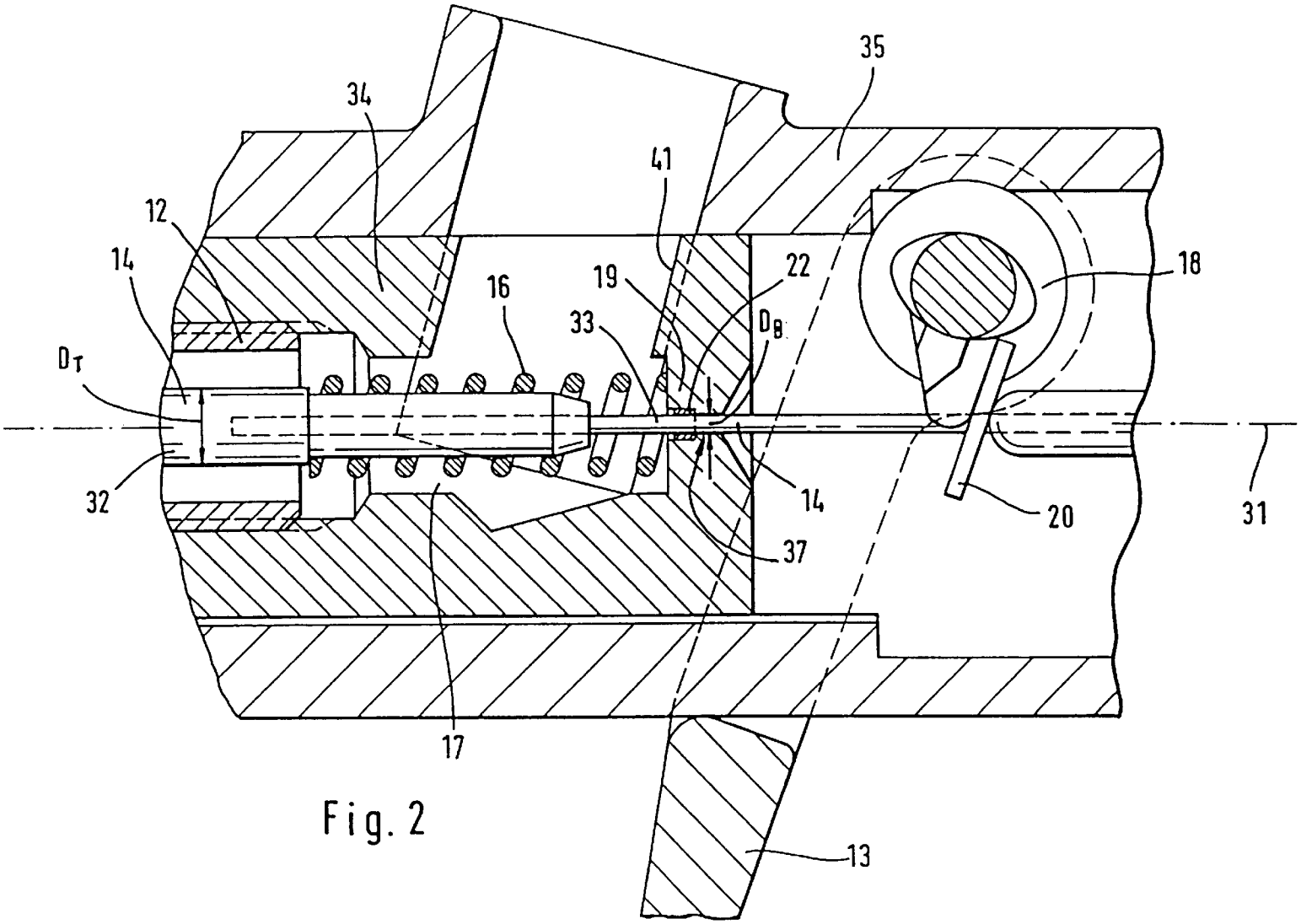
FIG. 2 shows an enlargement of the region A of FIG. 1.
Figure 3:
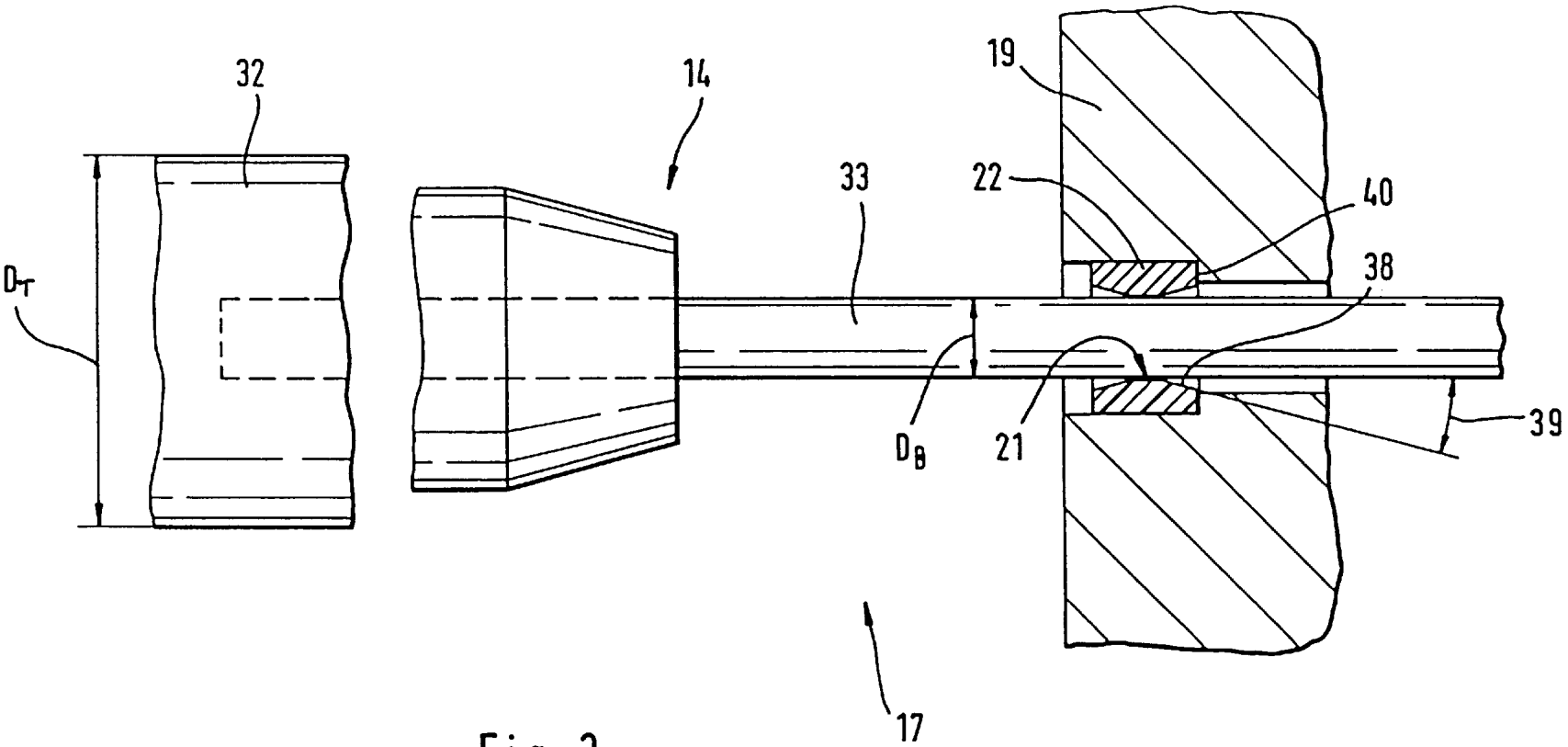
FIG. 3 shows an enlarged illustration of a portion of the wall section with guide means integrated into the sealing means, and also the nozzle needle from FIG. 2.

The gun 11 serves for the production of adhesive foam. It has a nozzle tube 12, a delivery lever 13, and a nozzle needle 14, which is coaxially arranged in the nozzle tube 12.

In the operating state, the gun is connected to the corresponding can of adhesive foam, namely by means of an adapter that can be fastened to a thread 41.

When the can of adhesive foam is screwed on, the fluid passes by means of a valve (not shown), without being foamed, into the cavity 17 and the nozzle tube 12.

By actuation of the delivery lever 13, force is transmitted by means of a coupling device 18 consisting of a lever, a pivot shaft and a fork, to the shoulder 20, which is rigidly connected to the nozzle needle 14. The nozzle needle is thereby pushed out to the right in FIG. 1 from its closing position, so that the fluid under pressure, present in the cavity 17 and in the nozzle tube 12, emerges through the outlet opening 35 on the nozzle tube 12.

The nozzle needle has essentially two regions: the region 32 which lies substantially within the nozzle tube 12, and the region 33, which extends substantially outside the nozzle tube, to the side remote from the outlet opening 35. The diameter $D_T$ of the region 32 of the nozzle needle 14 located in the nozzle tube 12 is larger than the diameter $D_B$ of the nozzle needle 14 in the region 33. In this embodiment, the diameter $D_B$ of the region 33 of the nozzle needle 14 is about 1 mm, and the diameter $D_T$ is 4 mm.

The region 33 of the nozzle needle 14 is of ordinary spring steel wire, which is not specially surface treated. No special requirements are placed on the roundness or cylindrical shape of the wire.

The nozzle needle 14 passes through a cavity 17, which is on the side of the nozzle tube 12 remote from the outlet opening 35, and through the wall section 19, which bounds the cavity 17. Outside the wall section 19, the nozzle needle 14 has a shoulder 20 which is engaged by the coupling device 18.

An annular seal 22 is arranged within the bore 37 of the wall section 19.

In this preferred embodiment, the seal is of Zytel™. Zytel™ is a trademark of the Dupont Company, and includes thermoplastic polyamides.

The seal is preferably 1.2 mm wide. The seal 22 has a sealing surface 21 which is preferably 0.25 mm wide and which guides the nozzle needle 14. The internal diameter of the seal is preferably about 0.9 mm, and its outer radius 1.7 mm.

A guide bevel 38 is located on each side of the sealing surface 21, and is inclined relative to the sealing surface 21 at an angle of preferably 15°.

The seal 22 has one side abutting the edge 40 of the wall section 19. The edge 40 can be arranged either between the seal 22 and the cavity 17, or else on the side of the seal 22 remote from the cavity, as shown.

If damage, such as score marks, occurs to the seal, on the one hand the seal shapes itself into the score marks, and on the other hand the healing of the damage is effected in that the damaged place is filled with fluid by the fluid under pressure, which is located in the cavity 17 when the gun is in operation, and solidification then takes place.

This self-healing process takes place in particular when the gun is used for the production of polyurethane foam.

Due to the preferred construction of the gun, it is possible to use a sealing material which is very cheap and is per se completely unsuitable as a sealant for polyurethane foam. The sealing material Zytel™ is a polyamide, which takes up water. Because it takes up water, it should not be used as a sealing material for polyurethane. However, because of the small amount of material for the seal, the amount of water taken up by the Zytel™ sealing material is minimal.

The self-healing properties of the seal and the required degree of sealing are improved in that the diameter of the nozzle needle 14 in the region 33 that passes through the seal is considerably reduced in comparison with the diameter of the nozzle needle 14 of the region 32 which lies substantially within the nozzle tube 12. Also, the bore 37 that passes through the wall section 19 has a very small diameter.

The wall section 19 is a part of a hollow body 34, in whose internal space the cavity 17 is located. The hollow body 34 can be of various materials, such as aluminum or plastic. The choice of the material depends on the stress to which the gun is to be subjected.

The hollow body 34 is in one piece.

Coaxial with the nozzle needle in the cavity 17 is a spring 16 that presses the nozzle needle 14 into the closing position when the delivery lever 13 is not pulled.

The housing 35 of the gun 11 is of plastic. The cap nut 26 is screwed onto a thread on the housing 35.

A further embodiment provides that the housing 35 and the hollow body 34 are of aluminum or plastic, and are made in one piece.

The delivery lever 13 and the coupling device 18 may be made of plastic or—if a gun that can be very highly stressed is desired—of metal.

I claim:

1. A gun for producing adhesive foam, comprising:

a nozzle tube, a delivery lever, a nozzle needle arranged coaxially in said nozzle tube, a force storing device for pushing said nozzle needle into a position in said nozzle tube closing said nozzle tube, a couple between said delivery lever and said nozzle needle, by which a given position of said delivery lever corresponds to a given position of said nozzle needle, a surface forming a cavity adjacent to said nozzle tube, a wall section bounding said cavity between said couple and said cavity, a seal, and a guide integrated into said seal.

2. The gun according to claim 1, in which a diameter of said nozzle needle $D_T$, measured perpendicularly to a longitudinal axis (31) of said nozzle needle (14) in a region (32) of said nozzle needle that lies substantially within said nozzle tube (12) is larger than a diameter $D_B$ in a region (33) of said nozzle needle (14) that is located in a region of said seal (22).

3. The gun according to claim 2, in which said diameter of said nozzle needle (14) is no larger than 0.5 times said diameter $D_T$ of said nozzle needle.

4. The gun according to claim 3, in which said diameter $D_B$ of said nozzle needle (14) is no larger than 0.3 times said diameter $D_T$ of said nozzle needle.

5. The gun according to claim 4, in which the ratio $D_B/D_T$ is equal to 0.15±0.10.

6. The gun according to claim 2, in which said diameter $D_B$ of said nozzle needle is less than 6 mm.

7. The gun according to claim 6, in which said diameter $D_B$ of said nozzle needle is less than 2 mm.

8. The gun according to claim 1, in which said adhesive foam comprises polyurethane foam.

9. The gun according to claim 1, in which said seal (22) is comprised of plastic material.

10. The gun according to claim 9, in which said seal (22) is comprised of polyamide.

11. The gun according to claim 10, in which said seal (22) is comprised of Zytel™.

12. The gun according to claim 2, in which said region (33) of said nozzle needle (14) that is located in a region of said seal (22) passes through said seal (22) and is comprised of spring steel.

13. The gun according to claim 2, in which said region (33) of said nozzle needle (14) that is located in a region of said seal (22) passes through said seal (22) and comprises wire.

14. The gun according to claim 1, in which said wall section (19) is a portion of a hollow body (34).

15. The gun according to claim 14, in which said hollow body (34) is in one piece.

16. The gun according to claim 14, in which said hollow body (34) comprises metal.

17. The gun according to claim 6, in which said hollow body (34) comprises metal.

18. The gun according to claim 14, in which said hollow body (34) is comprised of plastic.

19. The gun according to claim 14, further comprising a gun housing (35), in which said hollow body (34) comprises a portion of said housing (35).

20. The gun according to claim 16, further comprising a one piece gun housing (35), and said hollow body (34) comprises a portion of said housing (35).

21. The gun according to claim 14, in which at least one of said hollow body (34) and said housing (35) has a thread for connection with an adapter to which an adhesive foam can be attached.

22. A gun for producing adhesive foam, comprising:

a nozzle tube, a delivery lever, a nozzle needle arranged coaxially in said nozzle tube, a force storing device for pushing said nozzle needle into a position in said nozzle tube closing said nozzle tube, a couple between said delivery lever and said nozzle needle by which a given position of said delivery lever corresponds to a given position of said nozzle needle, a surface forming a cavity adjacent to said nozzle tube, a wall section bounding said cavity between said couple and said cavity, a seal, and a guide integrated into said seal, in which a diameter of said nozzle needle $D_T$, measured perpendicularly to a longitudinal axis of said nozzle needle in a region of said nozzle needle that lies substantially within said nozzle tube is larger than a diameter $D_B$ in a region of said nozzle needle that is located in a region of said seal.

* * * * *